US006534721B2

(12) United States Patent
Hoefner

(10) Patent No.: US 6,534,721 B2
(45) Date of Patent: Mar. 18, 2003

(54) HOLLOW INSULATOR AND PRODUCTION METHOD

(75) Inventor: Roland Hoefner, Küps (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/873,228

(22) Filed: Jun. 4, 2001

(65) Prior Publication Data

US 2001/0040046 A1 Nov. 15, 2001

Related U.S. Application Data

(63) Continuation of application No. PCT/DE99/03718, filed on Nov. 23, 1999.

(30) Foreign Application Priority Data

Dec. 4, 1998 (DE) ..... 198 56 123

(51) Int. Cl.[7] ..... H01B 17/00

(52) U.S. Cl. ..... 174/158 R; 174/140 C; 174/209; 174/211; 427/58

(58) Field of Search ..... 174/158 R, 31 R, 174/137 A, 140 C, 209, 211, 176, 178, 189, 196; 427/58

(56) References Cited

U.S. PATENT DOCUMENTS 4,053,707 A * 10/1977 Ely et al. ..... 174/209
4,312,123 A * 1/1982 Wheeler ..... 29/631
4,370,514 A 1/1983 Matthäus et al. ..... 174/31 R
4,387,266 A 6/1983 Matthäus ..... 174/31 R
4,476,155 A * 10/1984 Niemi ..... 427/58
4,920,380 A * 4/1990 Ueda et al. ..... 355/219
5,060,017 A * 10/1991 Ueda ..... 355/221
6,051,796 A * 4/2000 Kuhl et al. ..... 174/179

FOREIGN PATENT DOCUMENTS

| | | |
|---|---|---|
| DE | 32 08 358 A1 | 9/1983 |
| EP | 0 029 164 A1 | 5/1981 |
| EP | 0 032 690 A2 | 7/1981 |

* cited by examiner

*Primary Examiner*—Anthony Dinkins
*Assistant Examiner*—W. David Walkenhorst
(74) *Attorney, Agent, or Firm*—Laurence A. Greenberg; Werner H. Stemer; Gregory L. Mayback

(57) ABSTRACT

In a high-voltage hollow insulator, which has an insulating body, with a hollow support element made of a thermosetting composition, and a potential control device, the potential control device is encapsulated with the thermosetting composition of the support element and at least partially encoiled with fibers. For production, a blank of the support element is formed from the potential control device and the still soft thermosetting composition in accordance with the filament-winding process and is heated and cured. The hollow insulator can be produced in a simple and low-cost way. The structural design of the potential control device is no longer bound to mechanical requirements or requirements necessary for installation.

18 Claims, 4 Drawing Sheets

HOLLOW INSULATOR AND PRODUCTION METHOD

CROSS-REFERENCE TO RELATED APPLICATION

This is a continuation of copending international application PCT/DE99/03718, filed Nov. 23, 1999, which designated the United States.

BACKGROUND OF THE INVENTION

FIELD OF THE INVENTION

The invention relates to a hollow high-voltage insulator, which has an insulating body, with a hollow support element made of a thermosetting composition, and a potential control device. The invention also relates to a process for producing a hollow insulator of this type.

A hollow insulator of the foregoing type is used to allow current or voltage on high-voltage-carrying parts to be reliably measured by means of measuring transducers. A hollow insulator of this type is also used for example to allow high voltages to be conducted into a transformer. In the first case, the measuring transducer is arranged in the hollow space of the hollow insulator, one side of the measuring transducer being connected to the high-voltage-carrying part and the other side of the measuring transducer being connected to a measuring instrument or to ground. In the second case, a current conductor is for example led from a high-voltage-carrying line via the hollow space of the hollow insulator into the transformer.

The support element of the hollow insulator may be provided on its outer side with a cladding comprising shields. Silicone rubber has proven to be a successful material for the shields. The cladding of silicone rubber is thereby case solidly bonded to the thermosetting composition of the support element. This is also referred to as a composite insulator.

The thermosetting composition of the support element is decisive for the mechanical stability of the hollow insulator. A thermosetting composition is understood as meaning a highly polymeric material which is closely crosslinked up to the decomposition temperature and at lower temperatures is energy-elastic, and even at high temperatures does not have viscous flow. The glass transition temperature of a thermosetting composition always lies above 50° C.

Examples of thermosetting compositions are phenolics, aminoplastics, epoxy resins acrylic, and alkyd resins, as well as unsaturated polyester resins.

When using a hollow conductor for measuring or leading through high voltages or currents, there are inevitably very short distances between the parts being insulated, which are at very different potentials. Regions with critical field strengths are formed, at which flashovers or discharges can easily take place and can lead to the destruction of the hollow insulator or the device on which the hollow insulator is arranged. To avoid such phenomena, it is known from H ÜTTE, Taschenbücher der Technik [technology pocket books], Springer Verlag Berlin, Electrische Energietechnik [electrical power engineering), volume 2: Geräte [devices], 29th edition 1978, section 2.1.3.6, to design leading-through current conductors or lead-throughs in general as what are known as capacitor bushings with potential control. In that case, an insulating body made of hard paper, soft paper or casting resin, which contains concentrically arranged cylindrical conductive coverings, is applied directly to the current conductor to be led through. The conductive coverings become shorter from the inside outward and control the potential distribution between the conductor and ground.

Reference is had, in this context, to European published patent applications EP 0 029 164 A1 and EP 0 032 690 A2, which disclose high-voltage lead-throughs of this type with capacitive potential control inserts.

It has also been known for controlling the potential of lead-throughs in the interior of a hollow insulator to provide control electrodes which are electrically bonded to the fittings by which the hollow insulator is fastened. The potential distribution between the led-through conductor and ground can also be controlled in this way.

If capacitor bushings with control inserts are used, the control electrodes must be disadvantageously applied directly to the conductor in a complex and expensive process. Such a process is not required when a current conductor is led through a hollow insulator. However, for controlling the potential, the control electrodes must then be subsequently arranged in the interior of the hollow insulator, involving additional installation effort. This disadvantageously increases the production costs for a hollow insulator. Moreover, both configurations for potential controllers, or generally for potential control device, disadvantageously require additional installation space.

German patent No. DE 32 08 358 C2 also discloses a casting resin insulator in which capacitive field control inserts are cast into the casting resin body of the insulator as potential control device. For this purpose, first of all a preform with successively step-shaped transitional regions is cast. After removal from the casting mold, its circumferential surface is provided with an electrically conductive covering and subsequently, in a second casting operation, is encapsulated with an outer casting resin sheath. Since it is necessary to work with two casting molds and, moreover, many separate working steps are required, the process described is complex and cost-intensive, with the result that the casting resin insulator obtained in this way is disadvantageously very expensive.

SUMMARY OF THE INVENTION

The object of the present invention is to provide a hollow insulator and a production method which overcomes the above-noted deficiencies and disadvantages of the prior art devices and methods of this general kind, and wherein the hollow insulator can be produced in a particularly simple and low-cost process and the corresponding fabrication method is appropriately configured.

With the above and other objects in view there is provided, in accordance with the invention, a hollow high-voltage insulator, comprising:

an insulating body with a hollow support element made of a thermosetting composition, and a potential control device encapsulated with the thermosetting composition of the support element;

the potential control device being at least partially encoiled with fibers, and the support element built up by alternating insertion of the potential control device, coiling on of the fibers, and simultaneous or subsequent application of the thermosetting composition.

In other words, the potential control device is encapsulated with the thermosetting composition of the support element and at least partially encoiled with fibers.

The invention is in this respect based on the fact that the support element of a composite insulator is produced by curing a blank of the still soft thermosetting compositions. This is because it was recognized that, in this way, the potential control device can be arranged in the hollow insulator by being processed simultaneously with the soft thermosetting composition to form the blank. The joint processing takes place in this case by building up the blank layer by layer by alternating insertion of the potential control device, coiling with fibers and simultaneous or subsequent application of the thermosetting composition. It is also referred to as the filament-winding process. After the curing of the thermosetting composition, which, as known, takes place by a heat treatment, the potential control device is cast, i.e. solidly bonded, with the thermosetting composition of the support element. The support element is at the same time reinforced with fibers.

Neither the complex application of the potential control device to the conductor to be led through nor an additional installation effort for the potential control device to be subsequently introduced into the interior of the hollow insulator is required according to this novel invention. The invention combines the installation of the potential control device and the production of the support element into a single operation. Furthermore, no additional space in the interior of the hollow insulator is taken up by the potential control device encapsulated with the thermosetting composition of the support element.

The use of a thermosetting composition reinforced with glass fibers has been found to be particularly advantageous for the mechanical stability of the support element. Other insulating fibers, such as polyester or aramid fibers, can also be used. The latter are to be used for high strengths of the support element.

A particularly suitable thermosetting composition is epoxy resin.

For the electrical bonding of the potential control device, it is of advantage if the potential control device is encapsulated with the thermosetting composition in such a way that part of the potential control device is still freely accessible, i.e. is not covered by the thermosetting composition. Such a freely accessible location allows the remainder of the potential control device, lying inside the thermosetting composition, to be easily electrically bonded. If the potential control device is arranged entirely inside the thermosetting composition, the electrical bonding of the potential control device must be performed via a conductor led out from the thermosetting composition.

In an advantageous embodiment of the invention, the potential control device comprises a layer of electrically conductive material. In this way, a capacitive potential control can be achieved. It goes without saying that semiconducting material can also be used.

With a rotationally symmetrical design of the support element, for example as a circular cylinder or in a conically tapering form, it is also of advantage if the layer of the conductive material is formed into a tube, which may also be conically designed, with the center point in the longitudinal axis of the rotationally symmetrical support element. In this way, an effective potential dissipation control is achieved for a centrally led-through current conductor.

In a further advantageous embodiment of the invention, the potential control device comprises a plurality of tubes each made of the layer of conductive material, arranged in the rotationally symmetrical support element concentrically about the longitudinal axis of the support element and offset with respect to one another in a step-like manner. Such an arrangement allows both fine potential control and capacitive voltage measurement. In the latter case, the capacitance of the potential control device is led to the voltage measurement in an insulated manner.

It is favorable for production if the conductive layer is a metal foil, for example made of copper or aluminum. Metal foils of this type are commercially available inexpensively and can easily be processed with the thermosetting composition.

In order that no excessive potentials occur at the ends of the layers of metal foil in the hollow insulator, the end of the metal foil is advantageously rolled in or flanged. This avoids a sharp-edged transition between the metal foil and the matrix of the thermosetting composition.

With the above and other objects in view there is also provided, in accordance with the invention, a method of producing a high-voltage hollow insulator having an insulating body, with a hollow support element made of a thermosetting composition, and a potential control device, the method which comprises:

at least partially encoiling the potential control device in a filament-winding process, whereby a blank of the support element is formed by alternating insertion of the potential control device, coiling on of fibers, and simultaneous or subsequent application of the thermosetting composition;

encapsulating the potential control device with the thermosetting composition by heat treating the blank; and curing the thermosetting composition and thereby forming the support element.

In other words, a blank of the support element is formed from the potential control device and the still soft thermosetting composition, the potential control device is encapsulated with the thermosetting composition by heating the blank, and the thermosetting composition is cured, thereby forming the support element.

The blank of the support element is produced by what is known as the filament-winding process, in that fibers are coiled onto a shaped body with simultaneous or subsequent application of the thermosetting composition, with the potential control device being at least partially encoiled. The simultaneous application of the thermosetting composition takes place for example by using glass fibers impregnated with the thermosetting composition.

For introducing the potential control device, the layer may in this case be advantageously applied to the required regions as the first part-layer on the shaped body. This layer may comprise a metal foil or some other conductive material.

In this way, it is easily possible for a plurality of conducting or semiconducting layers to be incorporated in such a manner that they are arranged one behind the other, in order to obtain with the potential control device a finer dissipation control of the potential.

The invention additionally offers the advantage that no mechanical or installation-related requirements have to be taken into account in the structural design of the potential control device. The structural design of the potential control device is for the most part only dependent on electrical influences.

Other features which are considered as characteristic for the invention are set forth in the appended claims.

Although the invention is illustrated and described herein as embodied in a hollow insulator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
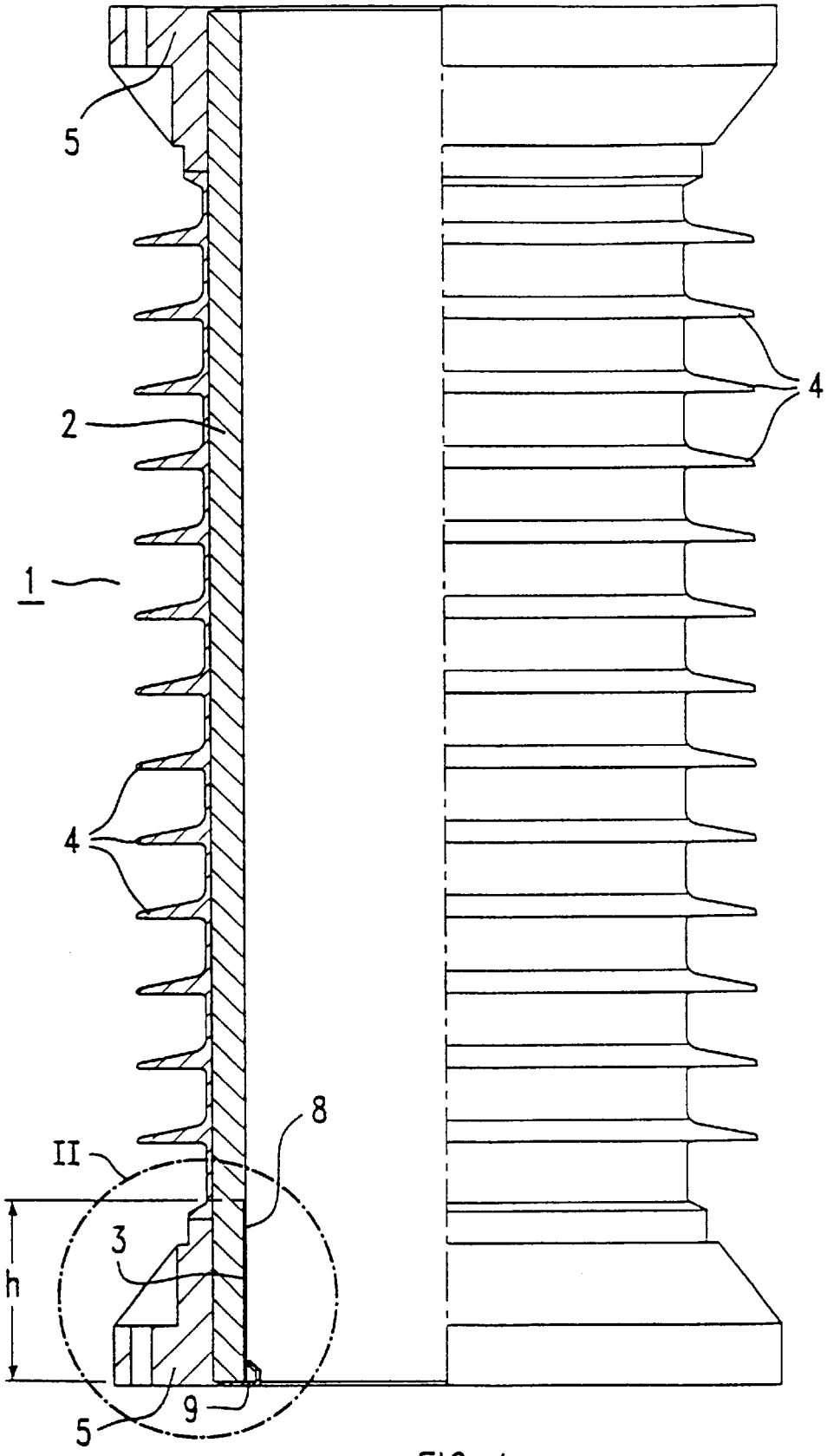
FIG. 1 is a partly broken-away view of a hollow insulator with a hollow-cylindrical support element, the potential control device in the form of a circumferential metal foil being encapsulated on the inner side of the support element with the thermosetting composition.

Referring now to the figures of the drawing in detail and first, particularly, to FIG. 1 thereof, there is seen a partly broken-away representation a hollow insulator 1 with a hollow-cylindrical support element 2 made of an epoxy resin reinforced with glass fibers and with a potential control device 3, which is encapsulated on the inner side of the hollow-cylindrical support element 2 with the epoxy resin. The outer side of the hollow-cylindrical support element 2 is encased with insulator shields 4 made of a silicone rubber. Furthermore, metallic fittings 5 are fastened on the ends of the hollow-cylindrical support element 2. The metallic fittings 5 serve for the fastening and grounding of the hollow insulator 1.

The potential control device 3 is formed as a metal foil of copper or aluminum, which runs around the inner side of the hollow-cylindrical support element 2 and thereby forms a potential control electrode in the form of a cylindrical tube of the height h. The height h is in this case governed by the specific potential conditions.

The metal foil of the potential control device 3 is encapsulated on the inner side of the hollow-cylindrical support element 2 with the epoxy resin in such a way that its inner surface 8 is not covered by the epoxy resin but is freely accessible. The inner surface 8 forms a common surface with the inner side of the hollow-cylindrical support element 2. Via the freely accessible inner surface 8 of the metal foil, the potential control device 3 is electrically bonded to the fitting 5 by means of a contact device 9 in the form of a metallic stranded wire.

What is known as the filament-winding process is used for producing the hollow-cylindrical support element 2. A cylindrical shaped body is firstly wrapped with the metal foil 6 of a corresponding width at the desired location, as the first part-layer. This metal foil 6 later forms the cylindrical-tubular potential control electrode of the potential control device 3. After wrapping the shaped body with the metal foil 6, the complete shaped body is encoiled with glass fibers.

For applying the epoxy resin, it is possible to use either what is known as the dry method, in which, once coiling has been completed, the blank of the support element 2 produced in this way is cast with epoxy resin, or else what is known as the wet method, in which glass fibers already impregnated with epoxy resin are coiled on. After achieving the desired blank of the support element 2, the blank is subjected to a heat treatment, in which the soft epoxy resin hardens. Subsequently, the hollow support element is pulled off the cylindrical shaped body.

Following the production of the support element 2, the encasement with insulator shields 4 made of silicone rubber is pushed, shrink-fitted or adhesively bonded onto the support element 2. The fittings 5 are adhesively bonded, shrink-fitted or fastened in some other way onto the support element 2.

The fact that the metal foil 6 is used as the first part-layer has the effect that the inner surface 8 of the cylindrical-tubular potential control electrode is free from epoxy resin and therefore is easily accessible. In this way, the potential control device can be easily electrically bonded to the fitting 5 via the contact device 9.

Figure 2:
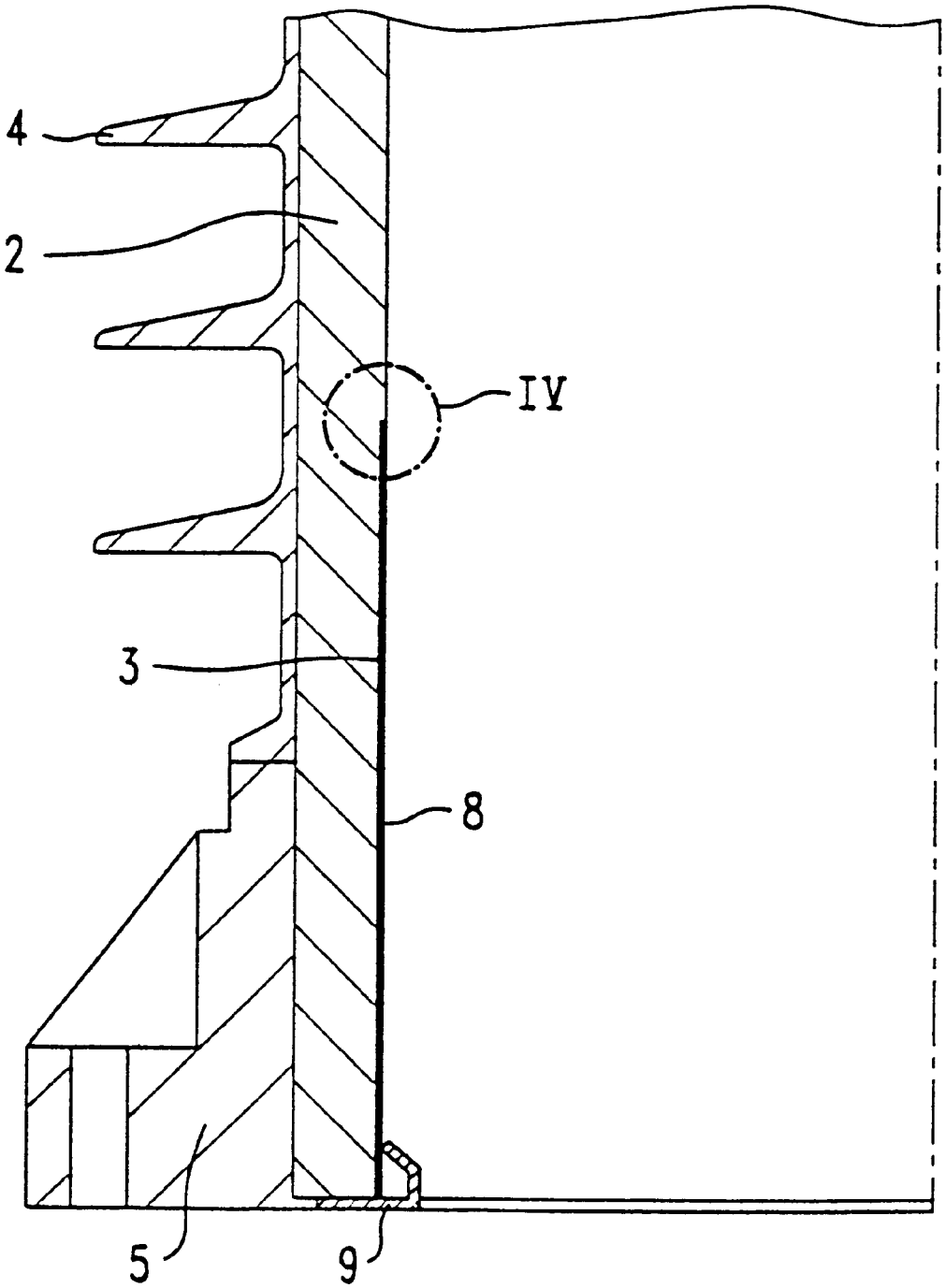
FIG. 2 is an enlarged detail from FIG. 1, showing the electrical bonding of the potential control device with a fitting.

Referring now to FIG. 2, there is shown an enlarged detail of the potential control device 3 of FIG. 1. There is clearly shown the electrical bonding of the metal foil of the potential control device 3 to the grounded metallic fitting 5 via a contact device 9 configured in the form of a metal stranded wire.

Figure 3:
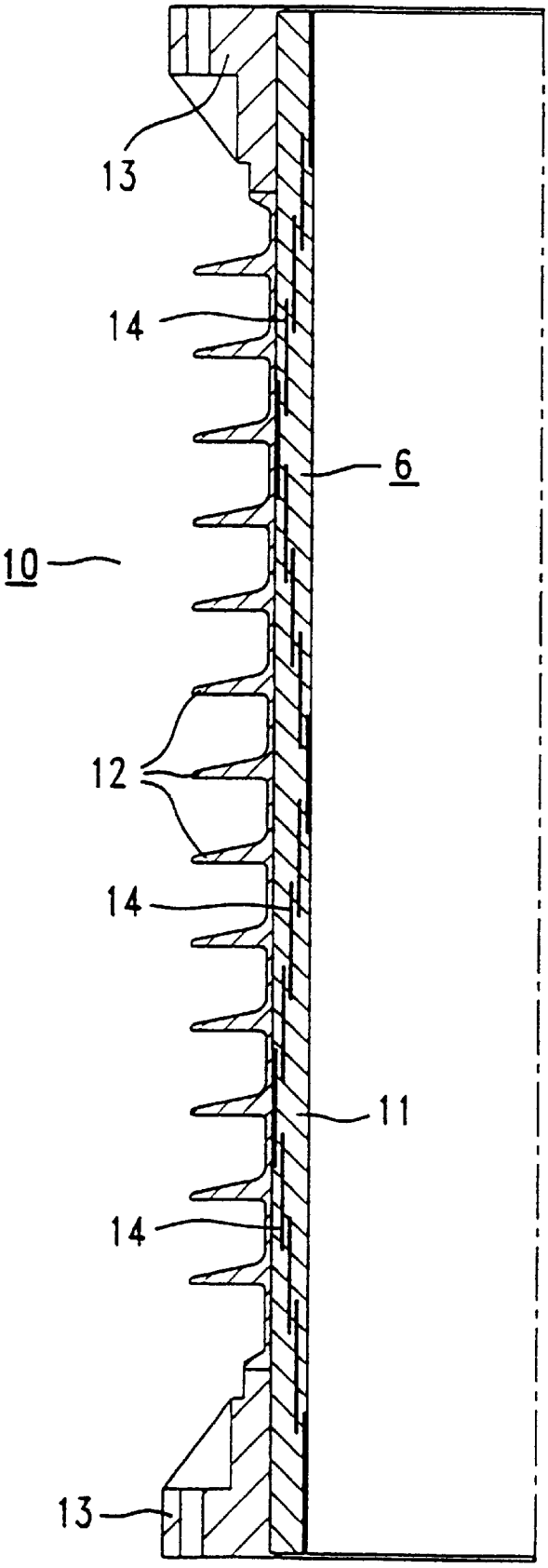
FIG. 3 is a longitudinal section of a hollow insulator with a hollow-cylindrical support element, the potential control device comprising a plurality of cylindrical tubes, each comprising a metal foil, arranged concentrically about the longitudinal axis of the hollow cylinder and offset with respect to one another in a step-like manner.

FIG. 3 shows in a section a hollow insulator 10 which likewise has a hollow-cylindrical support element 11 made of an epoxy resin reinforced with glass fibers, with a potential control device being encapsulated with the epoxy resin. The outer side of the hollow-cylindrical support element 11 is in turn encased with insulator shields 12 made of silicone rubber. At the ends of the hollow-cylindrical support element 11, metallic fittings 13 are fastened.

The potential control device 6 encapsulated with the epoxy resin comprises a number of cylindrical-tubular potential control electrodes 14 each comprising a metal foil, for example made of copper or aluminum. The cylindrical-tubular potential control electrodes 14 are in this case arranged concentrically with the center point in the longitudinal axis of the hollow-cylindrical support element 11 and distributed over the entire length of the support element 11. The individual cylindrical-tubular potential control electrodes 14 are in this case respectively offset with respect to one another in a step-shaped manner. The incorporation of a plurality of conducting potential control electrodes 14 arranged one behind other makes it possible to obtain a very fine dissipation control of the potential. A capacitive voltage measurement is also possible by means of such an arrangement.

What is known as the filament-winding process is again used for the production of the hollow-cylindrical support element 11, in which a number of cylindrical-tubular potential control electrodes 14 are encapsulated with the epoxy resin. In this process, the metal foil of a predetermined width is placed around a cylindrical shaped body at the appropriate location as the first part-layer. Subsequently, the metal foil together with the remaining shaped body is encoiled with glass fibers impregnated with epoxy resin. Once the desired thickness has been reached, a further metal foil of a predetermined width is placed around the then encoiled shaped body at an appropriate location as a further part-layer.

Subsequently, it is again encoiled with impregnated glass fibers. This process is successively repeated until the blank of the support element 11 has the desired thickness. After completion of the coiling operation, the blank of the support element 11, with the cylindrical-tubular control electrodes 14 contained in it, is subjected to a heat treatment for the curing of the epoxy resin. Subsequently, the shaped body is removed. Finally, the fittings 13 and the insulator shields 12 are applied to the hollow-cylindrical support element 11.

In order that no excessively strong fields occur during the later use of the hollow insulator at the ends of the metal foil inserted as the potential control electrode, the ends of the inserted metal foils may be either flanged or rolled in.

Figure 4:
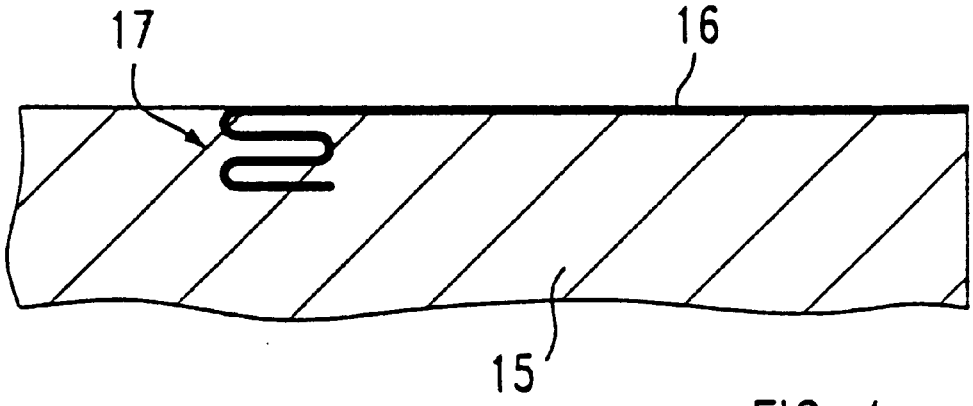
FIG. 4 is an enlarged detail from FIG. 2, showing a metal foil encapsulated with the thermosetting composition, with a flanged end.

In an enlarged detail from FIG. 2, a copper foil 16 encapsulated with the epoxy resin 15 of the support element and acting as the potential control device is shown in FIG. 4. The end 17 of the copper foil 16 is in this case flanged.

Figure 5:
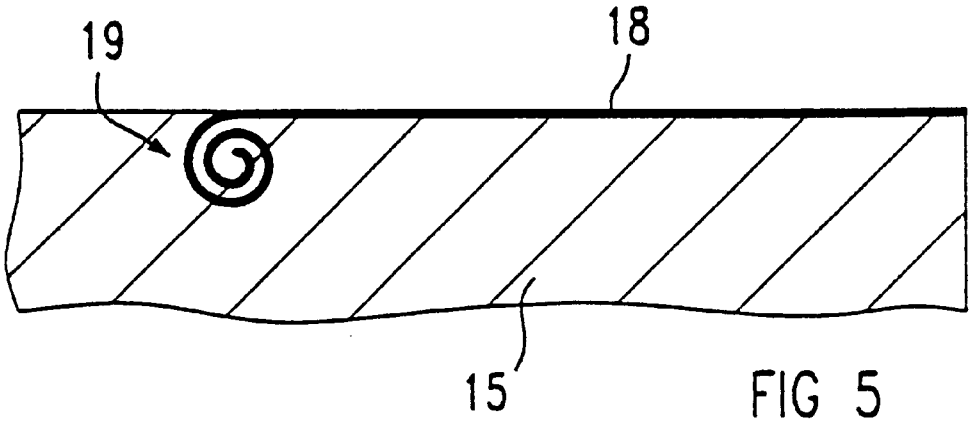
FIG. 5 is an enlarged detail from FIG. 2, showing a metal foil encapsulated with the thermosetting composition, with a rolled-in end.

FIG. 5 shows in this respect an alternative embodiment, an aluminum foil 18 being encapsulated with the epoxy resin 15 of the support element. The end 19 of the aluminum foil is in this case rolled-in.

I claim:

1. A hollow high-voltage insulator, comprising:

an insulating body including:

a hollow support element made of a thermosetting composition; and a potential control device encapsulated with said thermosetting composition of said support element, said potential control device being at least partially encoiled with fibers;

said support element being formed with said potential control device disposed at a desired location, said fibers coiled on said potential control device and said thermosetting composition applied on said fibers.

2. The hollow insulator according to claim 1, wherein said fibers are glass fibers.

3. The hollow insulator according to claim 1, wherein said thermosetting composition is an epoxy resin.

4. The hollow insulator according to claim 1, wherein a part of said potential control device is free from thermosetting composition.

5. The hollow insulator according to claim 1, wherein the potential control device comprises a layer of electrically conductive material.

6. The hollow insulator according to claim 1, wherein the support element is rotationally symmetrical.

7. The hollow insulator according to claim 6, wherein said potential control device comprises a layer of electrically conductive material formed into a tube with a center point in a longitudinal axis of said rotationally symmetrical support element.

8. The hollow insulator according to claim 7, wherein said potential control device comprises a plurality of tubes each formed of the layer of conductive material, arranged concentrically about the longitudinal axis of the rotationally symmetrical support element and offset with respect to one another in stepped fashion.

9. The hollow insulator according to claim 5, wherein said layer of conductive material is a metal foil.

10. The hollow insulator according to claim 9, wherein said metal foil is flanged at ends thereof.

11. The hollow insulator according to claim 9, wherein said metal foil is rolled in at its ends.

12. A method of producing a high-voltage hollow insulator having an insulating body, with a hollow support element made of a thermosetting composition, and a potential control device, the method which comprises:

at least partially encoiling the potential control device in a filament-winding process, whereby a blank of the support element is formed by alternating insertion of the potential control device, coiling on of fibers, and simultaneous or subsequent application of the thermosetting composition;

encapsulating the potential control device with the thermosetting composition by heat treating the blank; and curing the thermosetting composition and thereby forming the support element.

13. The method according to claim 12, which comprises using a layer of electrically conductive material as the potential control device.

14. The process according to claim 13, which comprises using a metal foil as the layer of conductive material.

15. The method according to claim 14, which comprises rolling in the metal foil at its ends.

16. The method according to claim 14, which comprises flanging the metal foil at its ends.

17. The method according to claim 12, which comprises using glass fibers as the fibers.

18. The method according to claim 12, wherein, in the step of coiling on the fibers, placing the layer of conductive material onto the shaped body as the first part-layer.

* * * * *